US012465822B1

(12) United States Patent
Chavan et al.

(10) Patent No.: US 12,465,822 B1
(45) Date of Patent: Nov. 11, 2025

(54) GOLF CLUB IRON COMPRISING SHEAR THINNING FILLER MATERIAL

(71) Applicant: Topgolf Callaway Brands Corp., Carlsbad, CA (US)

(72) Inventors: Vijay Chavan, Oceanside, CA (US); Joshua D. Westrum, San Diego, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 572 days.

(21) Appl. No.: 17/962,741

(22) Filed: Oct. 10, 2022

Related U.S. Application Data

(60) Continuation-in-part of application No. 17/399,260, filed on Aug. 11, 2021, now Pat. No. 11,771,966, which is a continuation of application No. 16/996,038, filed on Aug. 18, 2020, now Pat. No. 11,090,534, which is a continuation of application No. 16/540,917, filed on Aug. 14, 2019, now Pat. No. 10,744,379, which is a continuation-in-part of application No. 16/241,859, filed on Jan. 7, 2019, now Pat. No. 10,653,930, which is a continuation of application No. 15/927,917, filed on Mar. 21, 2018, now Pat. No. 10,173,108, which is a continuation-in-part of application No. 15/807,851, filed on Nov. 9, 2017, now Pat. No. 10,052,535, which is a continuation-in-part of application No. 15/718,285, filed on Sep. 28, 2017, now Pat. No. 10,039,964, which is a division of application No.

(Continued)

(51) Int. Cl.
*A63B 53/04* (2015.01)
*A63B 60/00* (2015.01)

(52) U.S. Cl.
CPC ..... *A63B 53/0475* (2013.01); *A63B 60/00* (2015.10); *A63B 60/002* (2020.08); *A63B 2209/00* (2013.01)

(58) Field of Classification Search
CPC . A63B 53/04; A63B 53/0408; A63B 53/0412; A63B 53/0466; A63B 53/047; A63B 53/0475
See application file for complete search history.

(56) References Cited

U.S. PATENT DOCUMENTS 4,650,626 A * 3/1987 Kurokawa ..... B29C 70/72 264/328.5
4,824,110 A * 4/1989 Kobayashi ..... A63B 60/00 473/347

(Continued)

FOREIGN PATENT DOCUMENTS

AU 2011306375 A1 * 5/2013 ..... A63B 53/04
CA 2823461 A1 * 3/2012 ..... A63B 53/04

(Continued)

*Primary Examiner* — Alvin A Hunter
(74) *Attorney, Agent, or Firm* — Michael A. Catania

(57) ABSTRACT

A golf club head with a cavity at least partially filled with a non-Newtonian shear thinning filler material is disclosed herein. The filler material may comprise multiple materials, such as microbubbles or microbeads, composite polyol materials, blowing agents, and/or graphene to improve performance and dampen sound after the golf club head impacts a golf ball.

2 Claims, 1 Drawing Sheet

Related U.S. Application Data

15/665,004, filed on Jul. 31, 2017, now Pat. No. 9,808,685.

(60) Provisional application No. 63/256,285, filed on Oct. 15, 2021, provisional application No. 62/457,086, filed on Feb. 9, 2017.

(56) References Cited

U.S. PATENT DOCUMENTS 5,007,643 A * 4/1991 Okumoto ..... B29C 70/66 273/DIG. 7
5,342,812 A * 8/1994 Niskanen ..... C22C 32/00 473/348
5,465,969 A * 11/1995 Cadorniga ..... A63B 53/04 473/346
5,507,985 A * 4/1996 Cadorniga ..... A63B 60/00 264/45.3
6,533,679 B1 * 3/2003 McCabe ..... A63B 60/02 473/335
6,835,144 B2 * 12/2004 Best ..... A63B 53/047 473/332
8,206,239 B2 * 6/2012 Gilbert ..... A63B 53/047 473/331
8,535,176 B2 * 9/2013 Bazzel ..... A63B 53/047 473/290
8,777,776 B2 * 7/2014 Wahl ..... A63B 53/047 473/345
9,808,685 B1 * 11/2017 Westrum ..... A63B 53/047
10,039,964 B1 * 8/2018 Westrum ..... A63B 53/047
10,052,535 B1 * 8/2018 Westrum ..... A63B 60/00
10,173,108 B2 * 1/2019 Westrum ..... A63B 53/047
10,653,930 B2 * 5/2020 Westrum ..... A63B 53/0475
10,744,379 B2 * 8/2020 Westrum ..... A63B 60/00
11,090,534 B2 * 8/2021 Westrum ..... A63B 53/0475
11,235,215 B2 * 2/2022 Spackman ..... A63B 53/0475
2008/0058117 A1 * 3/2008 Roach ..... A63B 53/047 473/332
2011/0014996 A1 * 1/2011 Shepherd ..... A63B 53/04 473/378
2011/0070963 A1 * 3/2011 Fedorochko ..... A63B 60/00 473/331
2013/0165258 A1 * 6/2013 Soracco ..... A63B 53/06 473/350
2014/0038744 A1 * 2/2014 Leatt ..... A63B 53/04 473/332
2017/0080300 A1 * 3/2017 Milleman ..... A63B 53/047

FOREIGN PATENT DOCUMENTS

CN 103370105 A * 10/2013 ..... A63B 53/04
CN 103370105 B * 6/2015 ..... A63B 53/04
JP 60122580 A * 7/1985
JP H06269515 A * 9/1994
JP 2013537831 A * 10/2013
WO WO-9635485 A1 * 11/1996 ..... A63B 53/04
WO WO-2012038921 A1 * 3/2012 ..... A63B 53/04

* cited by examiner

GOLF CLUB IRON COMPRISING SHEAR THINNING FILLER MATERIAL

CROSS REFERENCES TO RELATED APPLICATIONS

The present application claims priority to U.S. Provisional Patent Application No. 63/256,285, filed on Oct. 15, 2021, and the present application is a continuation-in-part application of U.S. patent application Ser. No. 17/399,260, filed on Aug. 11, 2021, which is a continuation application of U.S. patent application Ser. No. 16/996,038, filed on Aug. 18, 2020, now U.S. Pat. No. 11,090,534, issued on Aug. 17, 2021, which is a continuation application of U.S. patent application Ser. No. 16/540,917, filed on Aug. 14, 2019, and issued on Aug. 18, 2020, as U.S. Pat. No. 10,744,379, which is a continuation-in-part application of U.S. patent application Ser. No. 16/241,859, filed on Jan. 7, 2019, and issued on May 19, 2020, as U.S. Pat. No. 10,653,930, which is a continuation application of U.S. patent application Ser. No. 15/927,917, filed on Mar. 21, 2018, and issued on Jan. 8, 2019, as U.S. Pat. No. 10,173,108, which is a continuation-in-part application of U.S. patent application Ser. No. 15/807,851, filed on Nov. 8, 2017, and issued on Aug. 21, 2018, as U.S. Pat. No. 10,052,535, which is a continuation-in-part application of U.S. patent application Ser. No. 15/718,285, filed on Sep. 28, 2017, and issued on Aug. 7, 2018, as U.S. Pat. No. 10,039,964, which is a divisional application of U.S. patent application Ser. No. 15/665,004, filed on Jul. 31, 2017, and issued on Nov. 7, 2017, as U.S. Pat. No. 9,808,685, which claims priority to U.S. Provisional Patent Application No. 62/457,086, filed on Feb. 9, 2017, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to an iron-type golf club head with one or more shear-thinning materials filling at least a portion of a cavity within the iron-type golf club head.

Description of the Related Art

There is a need for golf club heads, and particularly irons, with one or more filler materials having improved sound damping properties.

BRIEF SUMMARY OF THE INVENTION

One aspect of the present invention is a golf club head with a filler comprising at least one shear thinning material, which reduces viscosity when force is applied. When a golf ball impacts the face of this golf club head, the shear thinning filler material reduces viscosity and allows the face to flex. As the force dissipates, the material's viscosity increases, which increases the damping properties of the material.

Another aspect of the present invention is a golf club head comprising a body comprising a striking face, a sole portion, a top portion, a rear portion, and a cavity, and a non-Newtonian shear thinning filler material, wherein the cavity is at least partially filled with the filler material. In some embodiments, the filler material may comprise polypropylene carbonate and thermoplastic polyurethane. In other embodiments, the filler material may comprise a plurality of microspheres. In still other embodiments, the filler material may comprise a plurality of microbubbles, which may be composed of a polymer material or glass. In another embodiment, the filler material may comprise a plurality of Expancel expandable microspheres. In still other embodiments, the filler material may comprise at least one material selected from the group consisting of silicone polyol, polyester polyol, polyether polyol, and polycarbonate polyol. In any of the embodiments, the filler material may further comprise graphene. In another embodiment, the filler material may comprise urethane with air pockets created by the reaction of isocyanate with water to create $CO_2$. In another embodiment, the filler material may be memory foam.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
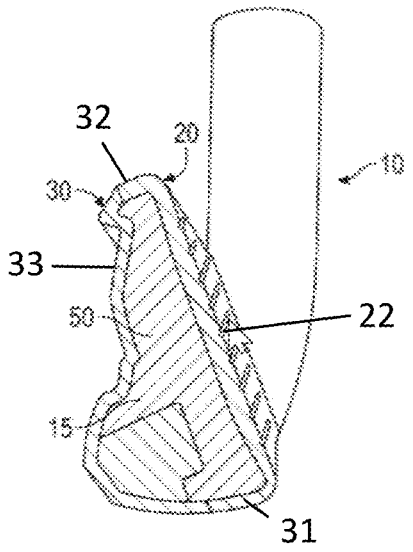
FIG. 1 is a cross-sectional view of a first embodiment of the golf club head of the present invention with the inventive non-Newtonian shear thinning filler material.
Figure 2:
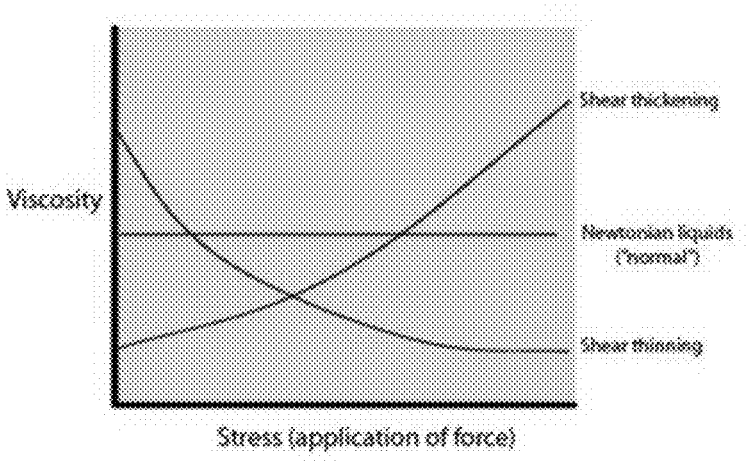
FIG. 2 is a chart illustrating the relationship between viscosity and stress for Newtonian and non-Newtonian materials.

The present invention is directed to a golf club head, and particularly an iron or hybrid-type golf club head with one or more cavities that are at least partially filled with one or more shear thinning, non-Newtonian fill materials. A preferred embodiment of a golf club iron 10 of the present invention is shown in FIG. 1. The iron 10 includes a face component 20 with a striking surface 22 that is affixed to a body section 30 with a sole portion 31, a top portion 32, and a rear portion 33 to form an interior cavity 15, which is filled with a non-Newtonian, shear thinning filler material 50. In the preferred embodiment, the non-Newtonian filler material 50 is a urethane comprising Expancel expandable microspheres, which are described in greater detail at nouryon-.com/products/expancel-microspheres. Preferably, the Expancel is added to the urethane mixture and when the mixture cures, voids are created due to the expansion of the microsphere in reaction to heating. The viscosity of the material 50 changes based on force placed on the material 50, and the voids created by the Expancel within the material 50 allow it to compress under those forces.

In another embodiment, the non-Newtonian filler material 50 is composed a polymer material that is softer than urethane and that comprises glass microbubbles. In other embodiments, the non-Newtonian filler material 50 includes one or more blowing agents. In still other embodiments, the non-Newtonian filler material 50 is created from urethane to which water is added during mixtures to create bubbles by polyurea formation. Isocyanate from urethane reacts with water to create CO2, which creates air pockets in the resulting filler material 50.

In any of the embodiments disclosed herein, graphene powder, such as C-650, can be added to the non-Newtonian filler material 50 to improve its overall durability. In another embodiment, the filler material 50 comprises two parts silicone based on addition cure. In another embodiment, the filler material 50 comprises one part silicone based on condensation cure. In another embodiment, the filler material 50 comprises one part silicone based on peroxide cure. In any of the embodiments, the filler material 50 is a hybrid polyurethane comprising silicone polyol, polyester polyol, polyether polyol, and polycarbonate polyol.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

Seluga et al., U.S. Pat. No. 9,757,629 for a Golf Club Head Having Stress Reducing Features is hereby incorporated by reference in its entirety.

Seluga et al., U.S. Pat. No. 9,776,058 for a Golf Club Head Having Optimized Ball Speed To CT Relationship is hereby incorporated by reference in its entirety.

Seluga et al., U.S. Pat. No. 11,433,281 for a Method For Manufacturing Golf Club Head Having Stress Reducing Features is hereby incorporated by reference in its entirety.

Gibbs et al., U.S. Pat. No. 11,433,282 for a Method For Manufacturing Golf Club Head Having Stress Reducing Features is hereby incorporated by reference in its entirety.

Davis et al., U.S. Pat. No. 11,400,349 for Golf Club Head With Heel And Toe Stiffeners is hereby incorporated by reference in its entirety.

Nunez et al., U.S. Pat. No. 11,364,423 for a Golf Club Head Having Stress Reducing Features is hereby incorporated by reference in its entirety.

DeMille et al., U.S. Pat. No. 11,331,544 for Binder Jet Printed Golf Club Components With Lattice Structures is hereby incorporated by reference in its entirety.

Westrum et al., U.S. Pat. No. 11,090,534 for a Golf Club Head Comprising Microscopic Bubble Material is hereby incorporated by reference in its entirety.

Frederickson, U.S. Pat. No. 11,083,939 for a Golf Club Head With Adjustable Sole Weight is hereby incorporated by reference in its entirety.

Del Rosario et al., U.S. Pat. No. 11,027,176 for a Golf Club Head With Hosel Support Structural is hereby incorporated by reference in its entirety.

Hanhart et al., U.S. Pat. No. 10,912,970 for a Golf Club Head Having Adjustable Stress Reducing Features is hereby incorporated by reference in its entirety.

Frederickson, U.S. Pat. No. 10,716,984 for a Golf Club Head With Adjustable Center Of Gravity is hereby incorporated by reference in its entirety.

DeMille et al., U.S. Pat. No. 10,105,579 for a Golf Club Head With A Compression-Molded, Thin-Walled Aft-Body is hereby incorporated by reference in its entirety.

Seluga, U.S. Pat. No. 10,099,096 for a Golf Club Head With Center Of Gravity Adjustability That Optimizes Products Of Inertia is hereby incorporated by reference in its entirety.

Seluga, U.S. Pat. No. 9,968,834 for a Golf Club Head With Adjustable Center Of Gravity is hereby incorporated by reference in its entirety.

DeMille et al., U.S. Pat. No. 9,283,447 for a Golf Club Head With Composite Face is hereby incorporated by reference in its entirety.

Griffin et al., U.S. Pat. No. 9,381,409 for a Multiple Material Iron is hereby incorporated by reference in its entirety.

DeMille et al., U.S. Pat. No. 9,387,373 for a Golf Club Head With Composite Weight Port is hereby incorporated by reference in its entirety.

Rice et al., U.S. Pat. No. 9,468,819 for a Golf Club Head is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. The section titles included herein also are not intended to be limiting. Therefore, the embodiments of the invention in which an exclusive property or privilege is claimed are defined in the following appended claims.

We claim:

1. A golf club head comprising:

a body comprising a striking face, a sole portion, a top portion, a rear portion, and a cavity; and a non-Newtonian shear thinning filler material, wherein the cavity is at least partially filled with the filler material;

wherein the filler material comprises urethane with air pockets created by the reaction of isocyanate with water to create $CO_2$.

2. A golf club head comprising:

a body comprising a striking face, a sole portion, a top portion, a rear portion, and a cavity; and a non-Newtonian shear thinning filler material, wherein the cavity is at least partially filled with the filler material;

wherein the filler material is memory foam.

* * * * *